US010034094B2

(12) United States Patent
Perkins

(10) Patent No.: US 10,034,094 B2
(45) Date of Patent: Jul. 24, 2018

(54) LOW-PROFILE LOUDSPEAKER

(71) Applicant: GP Acoustics (UK) Limited, Maidstone, Kent (GB)

(72) Inventor: George Perkins, Sittingbourne (GB)

(73) Assignee: GP ACOUSTICS (UK) LIMITED, Maidstone (GB)

( * ) Notice: Subject to any disclaimer, the term of this patent is extended or adjusted under 35 U.S.C. 154(b) by 0 days.

(21) Appl. No.: 15/267,596

(22) Filed: Sep. 16, 2016

(65) Prior Publication Data

US 2017/0085993 A1 Mar. 23, 2017

(30) Foreign Application Priority Data

Sep. 17, 2015 (GB) ..... 1516479.1

(51) Int. Cl.
*H04R 9/00* (2006.01)
*H04R 9/04* (2006.01)
(Continued)

(52) U.S. Cl.
CPC ..... *H04R 9/04* (2013.01); *H04R 7/02* (2013.01); *H04R 9/043* (2013.01); *H04R 9/06* (2013.01); *H04R 7/14* (2013.01); *H04R 2207/021* (2013.01)

(58) Field of Classification Search
CPC .... H04R 9/00; H04R 29/003; H04R 2209/00; H04R 2209/41; H04R 7/00; H04R 2207/00; H04R 7/06; H04R 7/12
(Continued)

(56) References Cited

U.S. PATENT DOCUMENTS 6,236,733 B1 * 5/2001 Kato ..... H04R 9/02 181/164
6,501,844 B2 * 12/2002 Proni ..... H04R 9/045 381/403
(Continued)

FOREIGN PATENT DOCUMENTS

EP 0914020 A2 5/1999
EP 1324632 A1 7/2003
(Continued)

OTHER PUBLICATIONS

Search Report issued for related UK patent application No. 1516479.1, dated Nov. 13, 2015.

*Primary Examiner* — Suhan Ni
(74) *Attorney, Agent, or Firm* — Westman, Champlin & Koehler, P.A.; Z. Peter Sawicki; Amanda M. Prose

(57) ABSTRACT

The present invention relates to a loudspeaker which can be arranged to minimise its overall depth while also increasing the breakup frequency and reducing potential rocking vibrations. Accordingly, the present invention is directed to a loudspeaker, comprising a magnet structure, and a voice coil lying within a magnetic field established by the magnet structure and responsive to electrical signals to undergo excursions from a rest position along an axis of motion; a driven body, connected to the voice coil and moveable to project acoustic waves from a front of the loudspeaker; and a suspension for providing a restoring force to the driven body towards the rest position, the suspension extending from an attachment point on the driven body to an attachment point on a fixed portion of the loudspeaker; wherein the driven body comprises a diaphragm and a support structure extending rearwardly from a connection point with the voice coil to a connection point with the suspension located rearward of the frontal part of the magnet structure.

13 Claims, 3 Drawing Sheets

(51) Int. Cl.
*H04R 9/06* (2006.01)
*H04R 7/02* (2006.01)
*H04R 7/14* (2006.01)

(58) Field of Classification Search
USPC ..... 381/396, 404, 423–424, 429, 432
See application file for complete search history.

(56) References Cited

U.S. PATENT DOCUMENTS 6,672,423 B2 * 1/2004 Kato ..... H04R 9/043 181/154
6,957,714 B2 * 10/2005 Takahashi ..... H04R 7/20 181/171
7,185,735 B2 * 3/2007 Sahyoun ..... H04R 7/122 181/147
7,225,895 B2 * 6/2007 Sahyoun ..... H04R 7/20 181/147
7,360,626 B2 * 4/2008 Sahyoun ..... H04R 7/122 181/163
7,433,485 B1 * 10/2008 Diedrich ..... H04R 9/06 381/404
7,548,632 B2 * 6/2009 Fukuyama ..... H04R 7/24 181/171
7,587,060 B2 * 9/2009 Watanabe ..... H04R 7/12 381/407
8,204,269 B2 * 6/2012 Sahyoun ..... H04R 9/043 381/398
2004/0076309 A1 * 4/2004 Sahyoun ..... H04R 9/06 381/412
2005/0201588 A1 9/2005 Funahashi et al.
2006/0120554 A1 6/2006 Watanabe
2006/0274914 A1 12/2006 Horigome et al.
2006/0285718 A1 12/2006 Funahashi
2009/0052724 A1 2/2009 Umemura
2010/0208934 A1 * 8/2010 Dohi ..... H04R 7/12 381/398
2012/0106776 A1 * 5/2012 Liu ..... H04R 7/14 381/413

FOREIGN PATENT DOCUMENTS

EP 1615467 A1 1/2006
EP 1696697 A1 8/2006
EP 1804551 A1 7/2007

* cited by examiner

LOW-PROFILE LOUDSPEAKER

CROSS REFERENCE TO RELATED APPLICATION

This application claims priority to and benefits of GB Patent Application No. 1516479.1, filed Sep. 17, 2015, the content of which is hereby incorporated by reference in its entirety.

FIELD OF THE INVENTION

The present invention relates to the field of loudspeakers, and especially relates to diaphragms and to loudspeakers having diaphragms.

BACKGROUND ART

A loudspeaker typically has a voice coil comprising a conductor through which a current may be passed, placed within a magnet assembly so that when current is passed through the voice coil an electromagnetic driving force is produced. This in turn drives a driven body, such as a diaphragm. Conventionally, this vibrates along the loudspeaker axis (i.e. the axis which passes from a front to a rear of the loudspeaker and which is substantially central to the loudspeaker, around which the loudspeaker is usually substantially rotationally symmetric), driven by a driver mechanism such as a voice coil as described. The movement of the diaphragm creates a pressure wave in the surrounding air, which propagates as a sound wave.

A loudspeaker diaphragm inevitably resonates at certain frequencies, the lowest of which is described in the art as a "breakup" frequency. Such resonances are generally undesirable, as they involve movements of the diaphragm that do not correspond to the electrical signal that is being applied via the voice coil. Thus, if they fall within the frequency range of the loudspeaker (or close to it) then they will affect the sound output. Generally, a stiff diaphragm will show resonance at a higher frequency, and efforts are often directed at increasing the stiffness of the diaphragm so that the resonant frequency is pushed to a higher level, allowing a higher frequency range for the loudspeaker. To this end, a concave cone diaphragm is commonly used as this combines a good surface area with an inherently stiff shape. A suspension is often attached to a rear face of the cone, and comprises a structure with a gentle elastic response in order to provide a restoring force to the diaphragm.

The diaphragm is typically set within an elastically-deformable surround which encircles the diaphragm and connects its outer edge to a fixed support structure. This provides a further gentle restoring force, and also creates an air seal separating the air volumes in front of and behind the diaphragm. The latter prevents dissipation of the pressure wave created by movement of the diaphragm by air flow to or from the converse-pressure region behind the diaphragm.

Where a loudspeaker is designed with a view to minimising its overall depth, such as where the available depth is at a premium, a simple cone shape may be impractical as it lends a significant depth to the loudspeaker. However, it remains important to maintain the stiffness of the diaphragm. Various options exist to cope with this challenge. One such method is shown in US2010/0208934 and US2012/0106776, and involves forming the diaphragm as a double cone, having a radially inner convex cone shape (as viewed from the exterior of the loudspeaker) and a radially outer concave cone shape. Viewed in section, the diaphragm thus adopts a "V" profile. The suspension is attached to the diaphragm at the apex of the V shape and the inner and outer edges of the V are attached to the voice coil and the surround respectively. Another solution is shown in our application GB2479941A, which describes a generally flat loudspeaker diaphragm with stiffening ribs projecting transversely away from a surface of the diaphragm.

A key requirement of a loudspeaker with a shallow overall depth is the provision of a sufficient excursion capability, so that a sufficient volume of air can be moved by the loudspeaker to meet the requirements thereof. This is especially relevant when the loudspeaker is intended to be used to generate sound in the lower-frequency ranges.

It is also a challenge that a simple flat shallow diaphragm may suffer from "rocking" movements, i.e. rotational oscillations about an axis perpendicular to the loudspeaker axis. Rocking vibrations may become problematic if the suspension of the loudspeaker is arranged in a plane that is close to the plane of the surround, as the combined moment that can be exerted by the two restoring forces to counteract a rocking movement is small. A rocking movement can cause the voice coil to become misaligned within the magnet arrangement and may cause contact between them, leading to damage to the voice coil.

SUMMARY OF THE INVENTION

Thus, it is an aim of the present invention to provide a loudspeaker which can be arranged to minimise its overall depth without incurring certain problems that arise from other known solutions to this this aim.

Accordingly, the present invention is directed to a loudspeaker, comprising a magnet structure, and a voice coil lying within a magnetic field established by the magnet structure and responsive to electrical signals to undergo excursions from a rest position along an axis of motion; a driven body, connected to the voice coil and moveable to project acoustic waves from a front of the loudspeaker; and a suspension for providing a restoring force to the driven body towards the rest position, the suspension extending from an attachment point on the driven body to an attachment point on a fixed portion of the loudspeaker; wherein the driven body comprises a diaphragm and a support structure extending rearwardly from a connection point with the voice coil to a connection point with the suspension located rearward of the frontal part of the magnet structure.

Thus, the diaphragm of the present invention can be largely flat, or only mildly convex/concave, without a peak portion between its inner rim and outer rim as described in US2010/0208934 and US2012/0106776. This means that the acoustic volume behind the diaphragm is maintained instead of being reduced by the V profile, leading to less acoustic impedance to movement of the diaphragm. Further, the shape for the connection point for the suspension is free and unconstrained by the design constraints on the diaphragm itself, and therefore an adequate surface area can be provided for an adhesive connection between the support structure and the suspension. This can be contrasted with US2010/0208934 and US2012/0106776 in which the suspension must be attached to an apex point in the V profile.

In the present invention, unwanted rocking movement or vibration as described above is addressed via an arrangement wherein the suspension is attached via the support structure, and thus in a plane that is spaced away from the diaphragm. This means that the moment of the total restoring force exerted on the diaphragm can be enough to discourage rocking motions.

An advantage of this arrangement is that it enables flexibility in positioning the support structure, so as to optimise heights for excursion clearances, for different sizes and preferred functions of loudspeakers.

The support structure can also stiffen the driven body, while keeping its weight low. Such stiffening reduces undesirable resonances. The support structure may thus comprise a first conical portion extending rearwardly outwardly from the connection point with the voice coil to the connection point with the suspension. The diaphragm may be connected to the support structure at the connection point with the voice coil. Further, the support structure may comprise a second conical portion extending forwardly outwardly from the connection point with the suspension.

The two conical portions introduce a shape to the support structure which may be described as having two frusto-conical regions, arranged so that their would-be apexes are oriented to be rearward and frontward, with respect to the loudspeaker, respectively. Such an arrangement may also be described as being bi-conical.

A yet further advantage of the loudspeaker of the present invention is that it may be assembled in a generally conventional manner, thus minimising any changes needed to the overall manufacturing processes.

The diaphragm may be connected to the support structure at an outer region of the second conical portion. In this way, the diaphragm, first conical portion and second conical portion form (in section) a highly rigid triangular shape which has a high stiffness and an elevated breakup frequency.

The loudspeaker may further comprise a flexible surround, attached to the support structure and/or the diaphragm at or near an outer region of the second conical portion.

The support structure may have at least one transition portion between slanted portions, at which the suspension can conveniently be connected. A transition portion and the conical portions may thus form a substantially "U" shape.

The support structure may have a plurality of apertures formed in its surface, to allow fluid communication between the interior space in front of the first and second conical portions and behind the rear face of the diaphragm. This establishes the volume within the support structure as part of the acoustic volume behind the diaphragm, thus reducing the acoustic impedance to movement of the diaphragm as described above. Reinforcing undulations can also be provided on the support structure, to increase its stiffness still further. The apertures and undulations are preferably combined into a single structure in the form of an aperture with a surrounding rib. They are ideally spaced substantially symmetrically around the diaphragm.

The loudspeaker may further comprise a frame at a rear of the loudspeaker.

BRIEF DESCRIPTION OF THE DRAWINGS

An embodiment of the present invention will now be described by way of example, with reference to the accompanying figures in which.

DETAILED DESCRIPTION OF THE EMBODIMENTS

Figure 1:
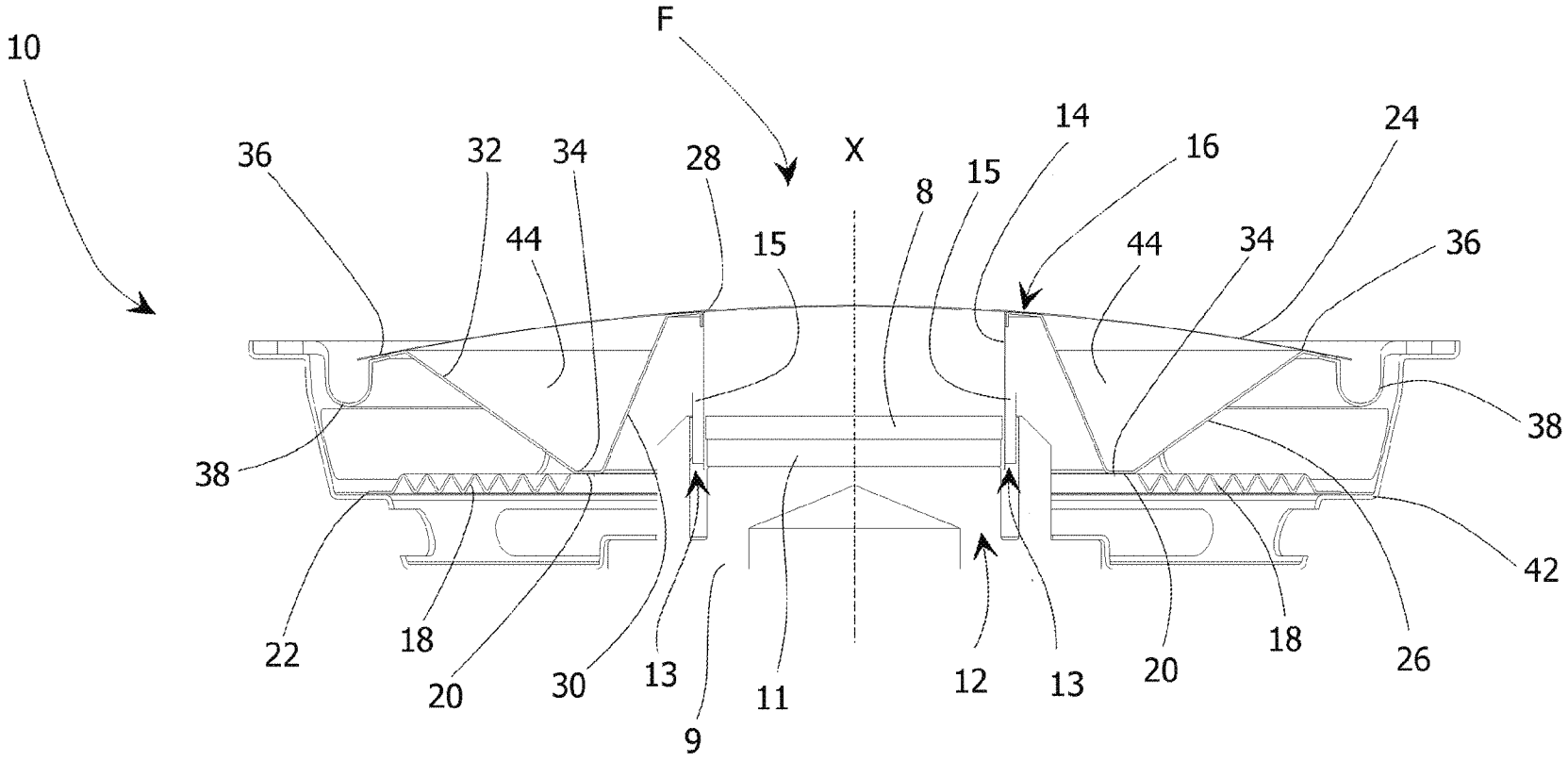
FIG. 1 shows a section through a loudspeaker embodying the present invention.

FIG. 1 shows a loudspeaker 10 embodying the present invention. This has a magnet structure 12, of a conventional format. A permanent magnet 11 is held within a pair of pole pieces 8, 9 which are shaped to direct the magnetic flux and create a strong localised magnetic field across a short annular gap 13 between opposing faces of the pole pieces 8. 9. A cylindrical voice coil former 14 lies within the magnetic field established in the gap 13 by the magnet structure 12, and carries a voice coil 15 which is then responsive to electrical signals to undergo excursions from a rest position along an axis of motion X. A driven body 16 is connected to the voice coil 14 and is moveable to project acoustic waves from a front F of the loudspeaker 10. A suspension 18 provides a restoring for to the driven body 16 towards the rest position, the suspension 18 extending from an attachment point 20 on the driven body 16 to an attachment point 22 on a fixed portion of the loudspeaker 10.

The driven body 16 comprises a diaphragm 24 and a support structure 26; the support structure 26 extends rearwardly from a connection point 28 with the voice coil 14 to the connection point 20 with the suspension 18. The support structure 26 has a first conical portion 30 extending rearwardly outwardly from the connection point 16 with the voice coil 14, and a second conical portion 32 extending forwardly outwardly from the connection point 20 with the suspension. Between the first conical portion 30 and the second conical portion 32 and at the connection point 20 with the suspension, the support structure has a transition portion 34. The transition portion 34 is substantially perpendicular to the axis of motion X, when the loudspeaker 10 is in the rest position. The first conical portion 30, the second conical portion 32, and the transition portion 34 together form a U-shape.

The diaphragm 24 extends across the front of the driven body 16 and is connected to the support structure 26 at the connection point 16 with the voice coil, and at an outer region 36 of the second conical portion 32. A flexible surround 38 is attached to the support structure 26 at an outer region 36 of the second conical portion 32. The diaphragm 24 is gently curved; this lends a generally flat profile to the frontal part of the loudspeaker and assists in creating a thin overall form factor. In this case, the diaphragm has a convex curve, i.e. creating a domed shape as viewed from the front of the loudspeaker, but other shapes are compatible with the present invention.

The support structure 26 has undulations or ribs (not shown in FIG. 1) formed therein for added stiffness, the ribs are spaced substantially symmetrically around the support structure 26. It also has apertures (not shown in FIG. 1) which allow air flow into and out of the enclosed region 44 between the diaphragm 24 and the support structure 26. This air flow can allow pressure differences resulting from ambient pressure changes to equalise, and (more importantly) means that the enclosed region 44 forms part of the acoustic volume behind the diaphragm 24. A large acoustic volume allows the movement of the diaphragm to be accommodated with less compression of the air within the volume, thereby reducing the acoustic impedance to movement of the diaphragm. The loudspeaker 10 also has a frame 42 at its rear which supports and houses the elements of the loudspeaker.

Figure 2:
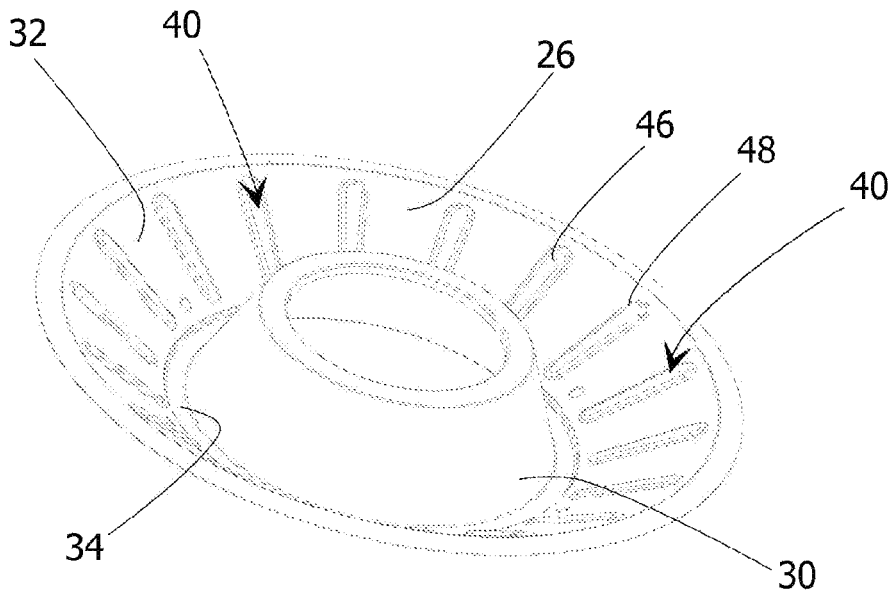
FIG. 2 shows a diaphragm of a loudspeaker embodying the present invention in perspective.

FIG. 2 shows the support structure 26 of FIG. 1 in more detail. The support structure 26 has a first conical section 30, a second conical section 32, and a transition portion 34 joining the two first 30 and second 32 conical sections. Thus, the support structure 26 has a U-shape. A plurality of structures 40 are symmetrically distributed around the support structure 26; each of these are in the form of an aperture 46 surrounded by an upstanding rib or ridge 48, to allow for fluid communication as noted above and also give added stiffness to the support structure.

Thus, the described structure gives rise to the advantages set out above, in the form of a stiff diaphragm in a shallow structure, which is resistant to rocking motions. The spacing of the suspension and surround from the centre of the rotation and from each other results in a leverage which has the effect of magnifying the radial stiffness of the suspension and the surround. As a result, the magnitude of any rocking motion will be reduced, thereby reducing the likelihood of the coil touching the adjacent stationary structures and resulting in less distortion of the output and a reduced likelihood of failure.

Figure 3:
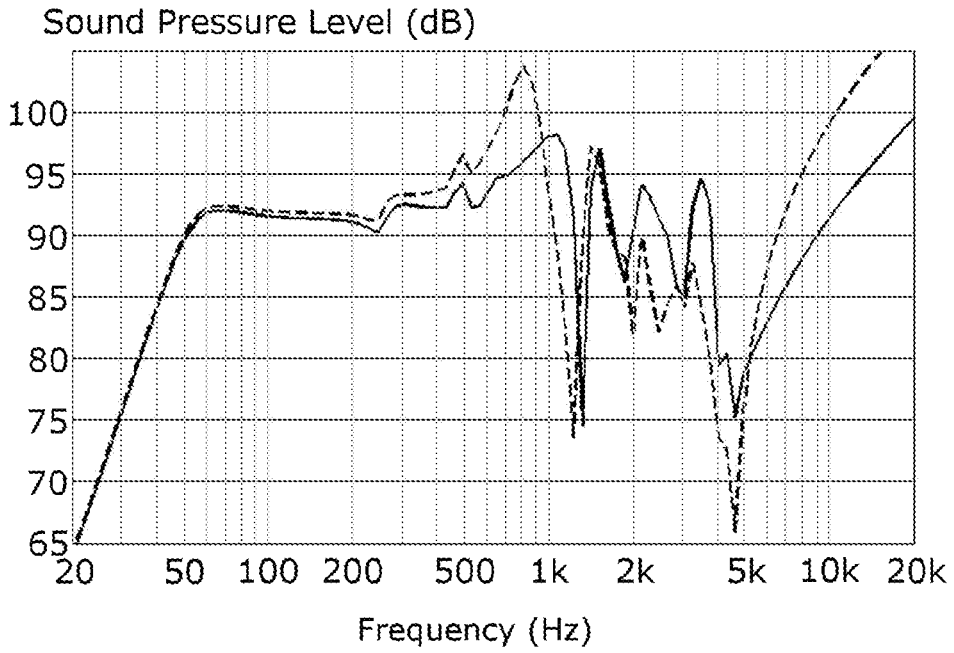
FIG. 3 shows frequency response curves for comparison between a loudspeaker with a double-cone diaphragm such as disclosed by US2010/0208934, and a loudspeaker embodying the present invention having a diaphragm with a support structure.

FIG. 3 shows a comparison between a frequency response of a loudspeaker with a double-cone diaphragm, shown as a dashed line, and a frequency response of a loudspeaker embodying the present invention, having a diaphragm with a support structure, shown as a solid line. It can be seen that a better frequency response is provided; non-linearities in the achieved sound pressure are less significant and/or are moved to higher frequencies.

Figure 4:
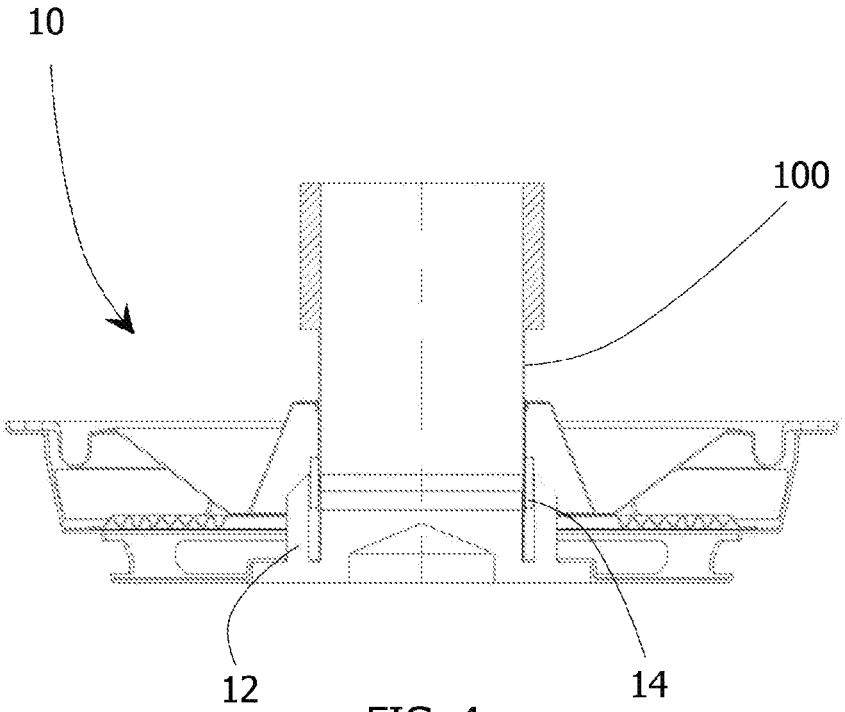
FIG. 4 shows a step of an assembly process of a loudspeaker embodying the present invention.

FIG. 4 shows a loudspeaker 10 embodying the present invention at a stage during its assembly process. Many of the features described above with respect to FIG. 1 are present in this drawing, but are not labelled in order to aid clarity. The voice coil 14 and the support structure 26 have been pre-assembled as a unit and are being centralised in the magnetic field gap of the magnet structure 12 using a shim-type jig 100. With the support structure 26 and voice coil 14 in the correct position, the suspension 18 and the surround 38 can be fitted and adhered to the frame 42 to secure the support structure 26 and voice coil 14 in that location. Once this has been fitted, jig 100 can be removed and the diaphragm 24 can be attached to the front of the support structure 26, for example by an adhesive attachment to the support structure 26. As noted above, the loudspeaker 10 may be assembled in a generally conventional way.

It will of course be understood that many variations may be made to the above-described embodiment without departing from the scope of the present invention.

What is claimed is:

1. A loudspeaker, comprising:

a magnet structure, and a voice coil lying within a magnetic field established by the magnet structure and responsive to electrical signals to undergo excursions from a rest position along an axis of motion;

a driven body, having a front connected to a voice coil former and moveable to project acoustic waves from a front of the loudspeaker; and a suspension for providing a restoring force to the driven body towards the rest position, the suspension extending from an attachment point on the driven body to an attachment point on a fixed portion of the loudspeaker;

wherein the driven body comprises a diaphragm and a support structure for supporting the diaphragm, the support structure having a front and a first conical portion extending rearwardly from a connection point with the voice coil former to a connection point with the suspension located rearward of the frontal part of the magnet structure, the diaphragm extending across the front of the driven body and across the front of the support structure, and being connected to the support structure at the connection point with the voice coil former.

2. The loudspeaker according to claim 1 wherein the support structure comprises a second conical portion extending forwardly outwardly from the connection point with the suspension.

3. The loudspeaker according to claim 2 in which the diaphragm is connected to the support structure at an outer region of the second conical portion.

4. The loudspeaker according to claim 2 further comprising a flexible surround, attached to at least one of the support structure and the diaphragm at an outer region of the second conical portion.

5. The loudspeaker according to claim 4, wherein the support structure has at least one transition portion between slanted portions, at the connection point between the support structure and the suspension.

6. The loudspeaker according to claim 5, wherein the at least one transition portion and the conical portions form a substantially "U" shape.

7. The loudspeaker according to claim 5, wherein the transition portion is substantially perpendicular to the axis of motion, when the loudspeaker is in the rest position.

8. The loudspeaker according to claim 1, wherein the support structure has at least one aperture to allow fluid communication therethrough.

9. The loudspeaker according to claim 8 in which the support structure has a plurality of apertures.

10. The loudspeaker according to claim 9 in which the apertures are spaced substantially symmetrically around the support structure.

11. The loudspeaker according to claim 1, wherein the support structure has a plurality of undulations formed in its surface.

12. The loudspeaker according to claim 11, in which the undulations are spaced substantially symmetrically around the support structure.

13. The loudspeaker according to claim 1, further comprising a frame at a rear of the loudspeaker.

* * * * *